United States Patent [19]

Maina

[11] Patent Number: 5,046,537

[45] Date of Patent: Sep. 10, 1991

[54] WEFT YARN RESERVE WINDING UNIT WITH ADJUSTABLE DIAMETER WINDING DRUM

[75] Inventor: Bruno Maina, Valdengo, Italy

[73] Assignee: Roj Electrotex S.p.A., Biella, Italy

[21] Appl. No.: 421,935

[22] Filed: Oct. 16, 1989

[30] Foreign Application Priority Data

Oct. 14, 1988 [IT] Italy ..... 22325 A/88

[51] Int. Cl.[5] ..... D03D 47/34

[52] U.S. Cl. ..... 139/452; 242/47.01

[58] Field of Search ..... 139/452; 242/47.01

[56] References Cited

U.S. PATENT DOCUMENTS

| | | | |
|---|---|---|---|
| 4,238,080 | 12/1980 | Van Mullekom | 242/47.01 X |
| 4,441,531 | 4/1984 | Umezawa et al. | 242/47.01 X |
| 4,498,639 | 2/1985 | Deborde et al. | 242/47.01 |
| 4,643,369 | 2/1985 | van Donk | 139/452 X |
| 4,850,400 | 7/1989 | Gorris | 139/452 |

FOREIGN PATENT DOCUMENTS

| | | | |
|---|---|---|---|
| 0142591 | 5/1985 | European Pat. Off. . | |
| 0181985 | 5/1986 | European Pat. Off. . | |
| 0290380 | 11/1988 | European Pat. Off. | 139/452 |
| 2428603 | 1/1980 | France . | |
| 2569728 | 3/1986 | France . | |
| 60-28550 | 2/1985 | Japan | 139/452 |

*Primary Examiner*—Andrew M. Falik

*Attorney, Agent, or Firm*—Young & Thompson

[57] ABSTRACT

In a measuring weft feeder for fluid jet looms, comprising a weft yarn reserve winding unit with variable turn length of the weft yarn that length can be adjusted with a single operation. For this purpose, the winding unit comprises a drum of adjustable diameter, formed by associating a fixed eccentric cylinder with a plurality of movable rods, parallel to the axis of the cylinder and surrounding a wide portion of its periphery, the distance of the rods from the cylinder being variable and adjustable for each rod or for groups of rods. For each rod or group of rods, a control arm is provided slidable in a guide of the winding unit positioned perpendicularly to the axis of the unit, the arms being movable simultaneously in the respective guides under the control of a single operating member.

7 Claims, 9 Drawing Sheets

WEFT YARN RESERVE WINDING UNIT WITH ADJUSTABLE DIAMETER WINDING DRUM

BACKGROUND OF THE INVENTION

It is known that in modern fluid jet looms (air and water looms) it has become of common use to employ measuring weft feeders equipped with their own electric motor and with a system to control and stop the amount of weft yarn supplied to the loom at each weft picking.

Such measuring weft feeders usually comprise: an electric motor allowing, by means of a rotary member (winding reel), to draw the weft yarn from the spool and wind the same into turns, evenly arranged on the outer surface of a winding unit; means (sensors) to control the amount of weft yarn present on the winding unit, and means (photoelectric cells) to control the weft yarn turns being unwound; and one or more devices, usually of the electromagnetic type, to stop the weft yarn being unwound so as to block the same after weft picking.

Two different systems are adopted, at present, to feed the loom with the right length of weft yarn required for the weaving being performed, said length mainly depending on the width of the fabric being woven, but also on the type of fabric and on the type of yarns used for weaving the same. In fact, the measuring weft feeders can be of two types: the type which comprises a unit for winding up a fixed length of weft yarn reserve turns, namely a cylinder of fixed diameter commonly called a drum, and which uses a plurality of devices to stop the yarn, positioned evenly spaced over a ring around the drum; and the type which uses instead a single device to stop the weft yarn, but wherein use has to be made of a winding unit with variable turn length, this latter being adjustable each time according to the weft yarn length having to be inserted into the loom shed.

In the first type of measuring weft feeder, the adjustment of the weft yarn length L to be picked is performed by counting the number of whole turns contained in L and selecting, for each weft picking, the electomagnetic stopping device having to be operated, so that its angular position may correspond to the turn fraction closest to the value required to complete the length L: in this way it is possible to perform a stepwise adjustment of the length L, essentially by electronic means.

In the second type of measuring weft feeder, the adjustment of the length L of weft yarn to be picked is instead performed by varying the length of the turns on the winding unit through shifting of a discrete number of movable rods which form, in combination with a fixed cylinder, the aforespecified unit or drum; on said drum, the weft yarn is generally wound along a polygonal path, the length of which is equal to the length of a whole turn of wound yarn.

The present invention relates to improvements in this second type of measuring weft feeder and it concerns, in particular, the adjustment of the turn length on its winding unit or drum (namely, the adjustment of the diameter of this latter).

Up to the present, in the measuring weft feeders of the type being considered, the adjustment of the turn length on the winding unit has generally been performed by manually changing the radial position of the single rods (or—in the event of these being assembled so as to form a plurality of sectors—the position of the single sectors), so as to suitably draw the movable rods either toward or away from the fixed cylinder.

It is evident that the manual adjustment of the position of the single rods (or of sectors or groups thereof) involves a certain effort on the operator's part, in that it requires separately adjusting the position of the single elements, thereby guaranteeing, as well as the right turn length, also the regularity of the polygonal path being followed by the reserve turn when it winds around said rods. Said regularity is a very important condition for the proper working of the measuring weft feeder, since the closer the polygonal path approaches a circular shape, the easier it is for the weft yarn to be unwound at high speed, preventing tears and tension changes which may be determined by sudden variations in the curvature radius of the outer surface of the winding unit.

In conclusion, whenever having to vary the turn length on the winding unit or drum of known measuring weft feeders, the operator is forced to perform an exacting work with a considerable waste of time, and the adjustment obtained is often not as efficient as it should be, which can cause great inconveniences especially as to loom productivity and quality of the fabric.

SUMMARY OF THE INVENTION

The present invention provides an improved construction of the winding unit in measuring weft feeders for fluid jet looms, of the type with variable turn length, which allows overcoming the aforementioned drawbacks and obtaining important technical advantages, both as to the geometrical regularity of the turn length on the winding unit, and as to the easy and prompt adjustment of said unit.

For this purpose, the invention provides a weft yarn reserve winding unit for measuring weft feeders, of the type comprising a drum of adjustable diameter formed by associating a fixed eccentric cylinder with a plurality of movable rods, parallel to the axis of said cylinder and surrounding a wide portion of its periphery, the distance of said rods from said cylinder being variable and adjustable for each rod or for groups of rods, said unit being characterized in that, for each rod or group of rods, a control arm is provided slidable in a guide of the winding unit positioned perpendicularly to the axis of said unit, said arms being movable simultaneously in the respective guides—the length of the strokes varying from one arm to the other—under the control of a single operating member, and means being provided to lock said arms into said guides with the movable rods in the wanted position.

The winding unit preferably comprises three groups of at least three rods joined in sectors, a control arm for each sector and a prismatic guide for each arm, two of said guides forming between them a wide angle, preferably of about 90°, and the third guide being positioned according to the bisecting line of said angle.

In a preferred embodiment of the invention, the arms of said sectors each carry a rack with which engage gears controlling the movements of the arms in said guides, a first stepped gear—forming said single operating member—controlling directly the arm of the central sector and, simultaneously, through two further gears, the arms of the other two sectors, with gear ratios adapted to maintain the rods along a circumference.

BRIEF DESCRIPTION OF THE DRAWINGS

Some embodiments of the invention are now described in further detail, by mere way of example, with reference to the accompanying drawings, in which.

DESCRIPTION OF THE PREFERRED EMBODIMENTS

Figure 1:
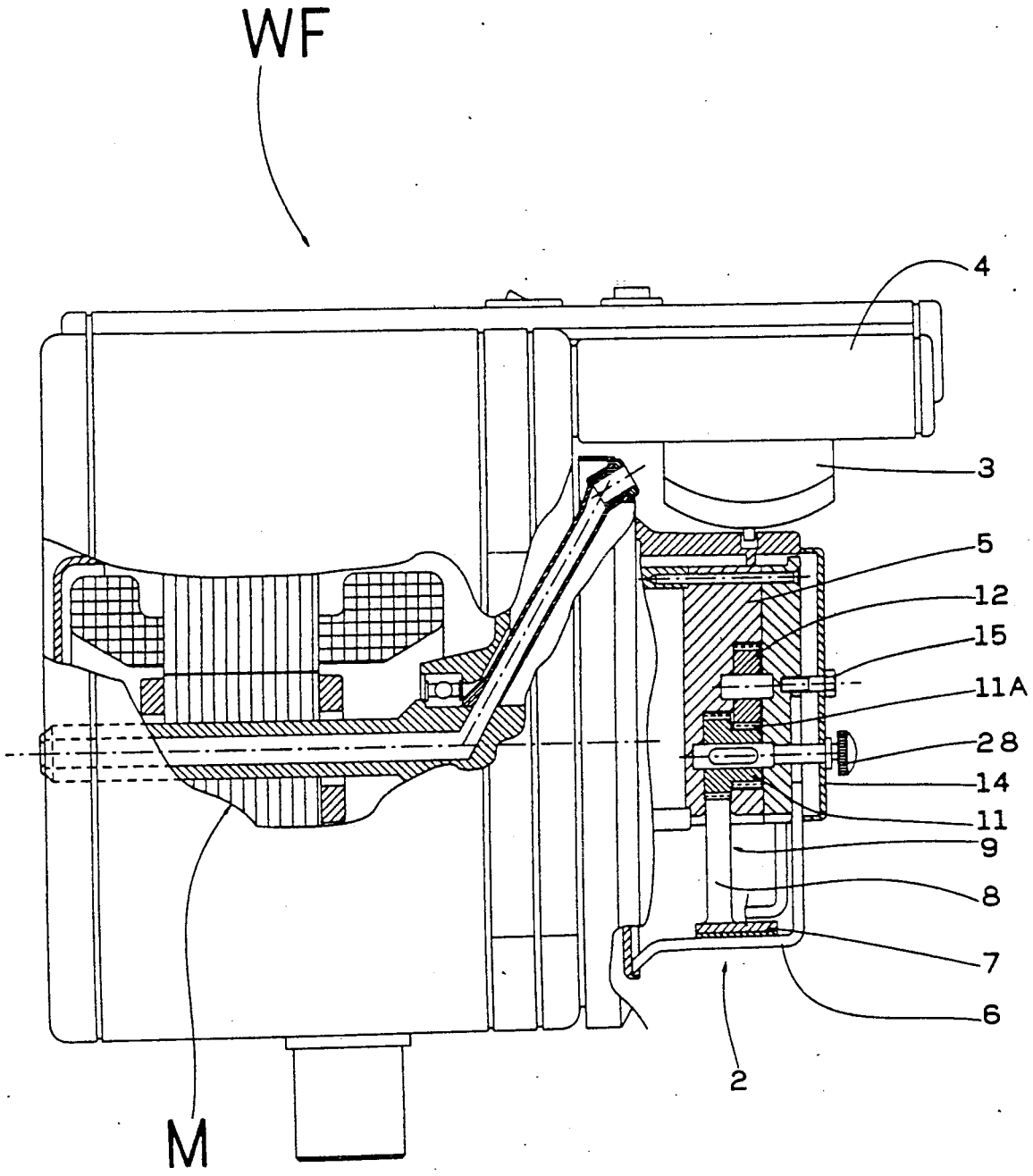
FIG. 1 is the side view of a measuring weft feeder, according to a first embodiment of the present invention, with the weft yarn reserve winding unit shown in section.
Figure 2:
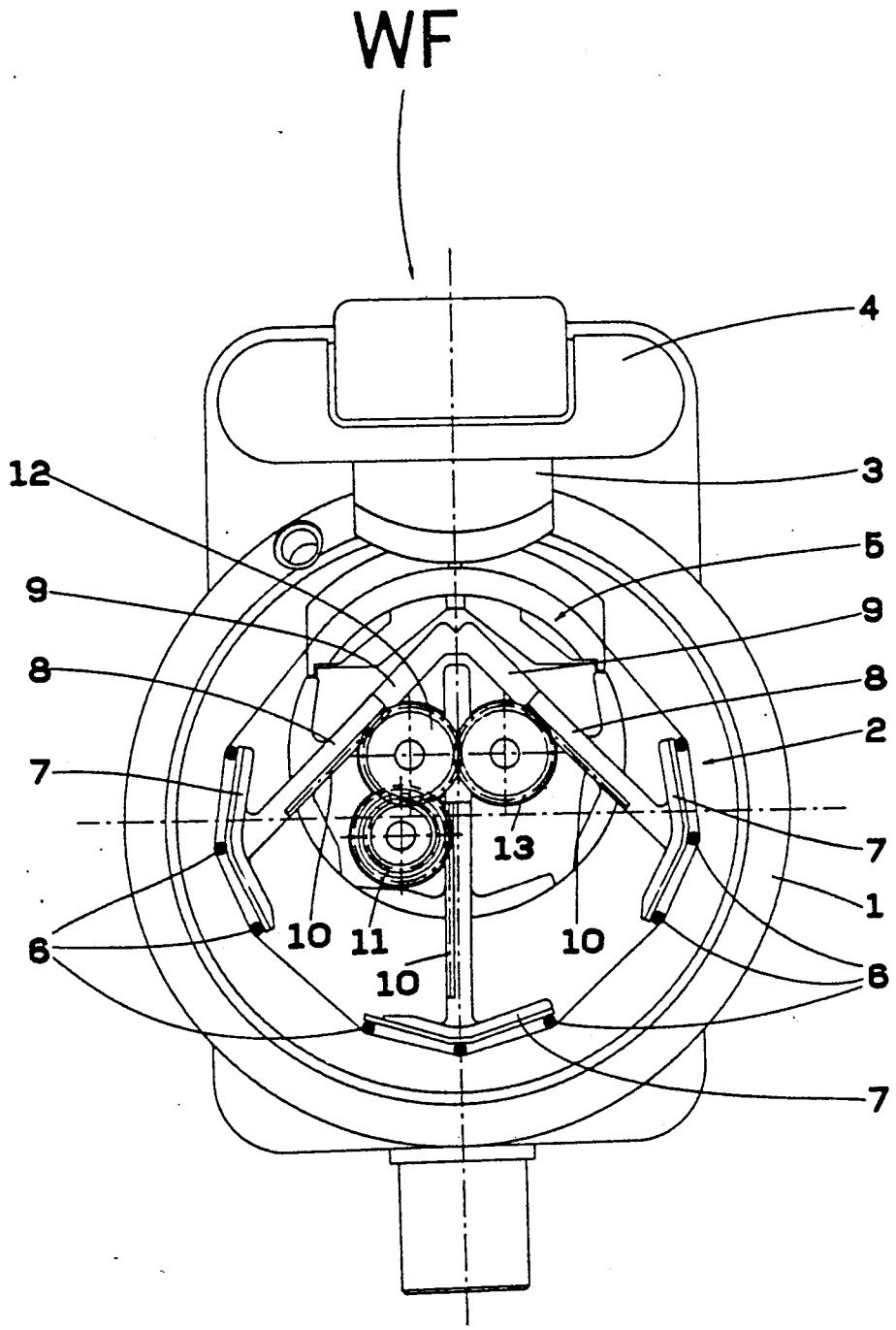
FIG. 2 is a front view of the winding unit of the measuring weft feeder of FIG. 1, showing a first condition of adjustment (movable rods at the maximum distance from the fixed eccentric cylinder of the unit)
Figure 3:
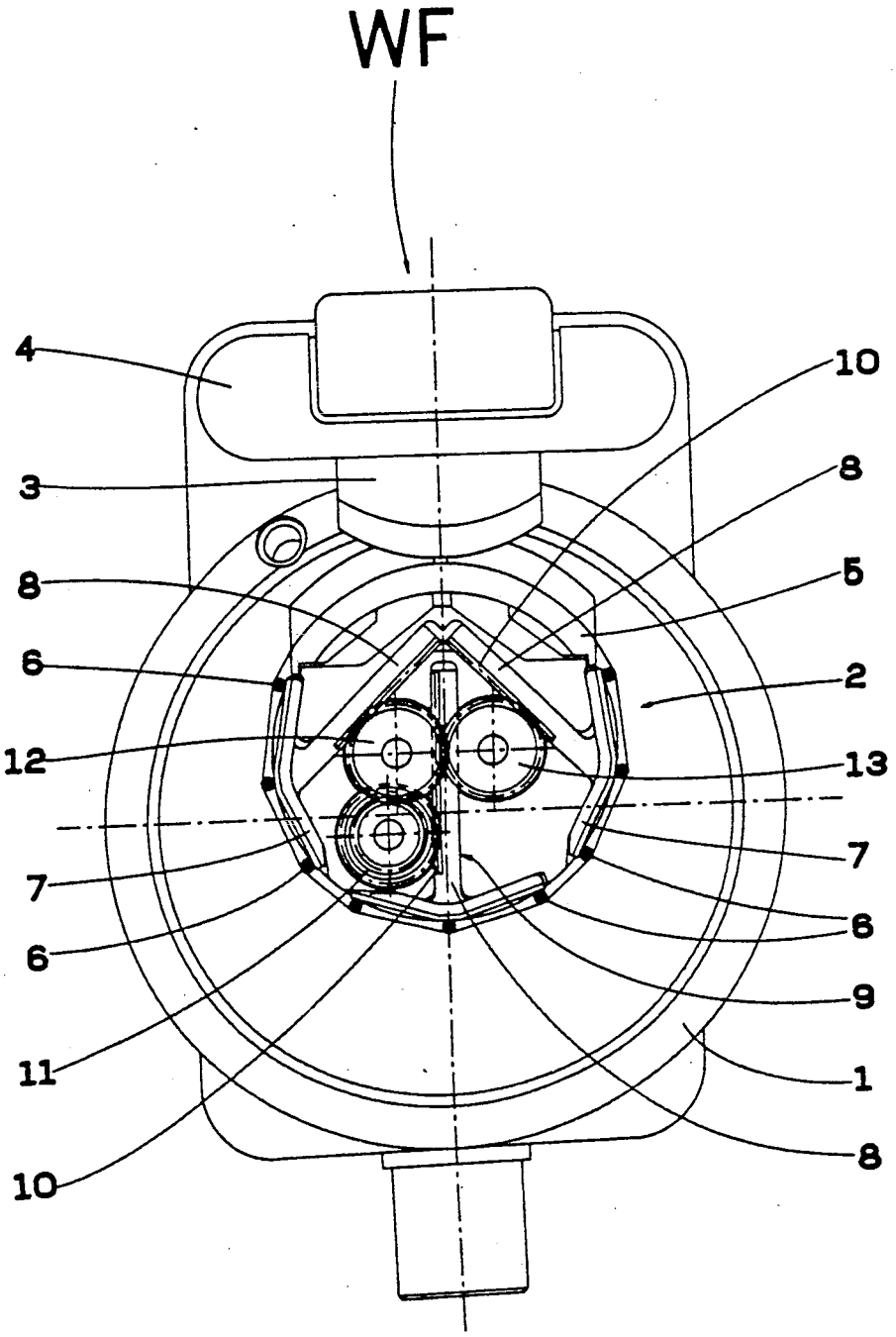
FIG. 3 is a view similar to that of FIG. 2, but showing the opposite condition of adjustment (movable rods at the minimum distance from the fixed eccentric cylinder of the unit)

Referring first of all to FIGS. 1 to 3 of the accompanying drawings, a measuring weft feeder WF comprises, in known manner: an electric motor M, which causes the rotation of a reel 1 to wind up, into even turns, a weft yarn reserve (drawn from a spool) on the winding unit 2 commonly called a drum; an electromagnetic unit 3, which stops the weft yarn being drawn by the loom, as it unwinds from the reserve formed on the unit 2; and various sensors, housed in a sheath 4. Also in known manner, the winding unit 2 consists of a fixed cylinder 5 and of a plurality of movable rods 6. The fixed cylinder 5 is positioned eccentric in respect of the rotor 1. The assembly of rods 6 surrounds the periphery of the cylinder 5 over most of its extent, but not over its portion facing the electromagnetic unit 3. According to the invention, the rods 6 are joined in sets of three (FIGS. 2 and 3) on three sectors 7, to which there are fixed control arms 8 slidable in prismatic guides 9 of the unit 2. The guides 9 are divergent, starting from the area of the winding unit with no rods, two of said guides forming between them an angle of about 90° and the third guide being positioned on the bisecting line of said angle. The control arms 8 each carry on one side a rack 10, with which engage gears allowing control of the movements of said arms along the guides 9. More precisely, a stepped gear 11, or double sprocket—which is also the only operating member of the unit—engages directly, with its major pitch circle diameter, the rack 10 of the arm 8 of the intermediate sector, while two further gears 12 and 13, having a diameter equal to the minor diameter of the stepped gear 11, are reciprocally engaged and engage in turn with the racks 10 of the other two control arms 8, one of said gears (12) being moreover in engagement with the sprocket 11A (see FIG. 1) forming the portion with minor diameter of the stepped gear 11.

When having to vary the turn length on the winding unit, it is sufficient to rotate the stepped gear 11 in the appropriate direction, by means of the control knob 28 (FIG. 1), after having unlocked the rods 6 by loosening the screw 15: it is thus possible, according to requirements, to move the sectors 7 away from or toward the fixed cylinder 5. The gear 11 causes in fact the arm 8 of the unit to move in the respective guide 9 in the appropriate direction. At the same time—but with different stroke lengths—the other two control arms 8, and thus the sectors 7 of the side rods 6, are shifted by means of the gearing 11A, 12 and 13 engaging with the racks 10. The gear ratio between the sprocket 11A and the gears 12 and 13 is chosen in such a way as to position, in every condition, the three rod sectors so as to impose on the turns a very regular geometrical path: the unwinding of the weft yarn from the winding unit will thus take place under the best manner and in conditions which are very similar to those of a conventional cylindrical drum.

The two essential objects of the invention are thereby reached: to obtain, with a single operating member, the simultaneous shifting of all the movable rods of the winding unit, and to keep the periphery of said unit very regular.

It is to be understood that, by operating the stepped gear 11, it is possible to obtain all the intermediate configurations between that of minimum and that of maximum distance of the rods 6 from the cylinder 5, as shown in FIGS. 2 and 3.

To lock the rods 6 in the selected position of adjustment, once said position has been reached, use is made of the external locking member 14 (FIG. 1), fixed by one or more screws 15.

Figure 4:
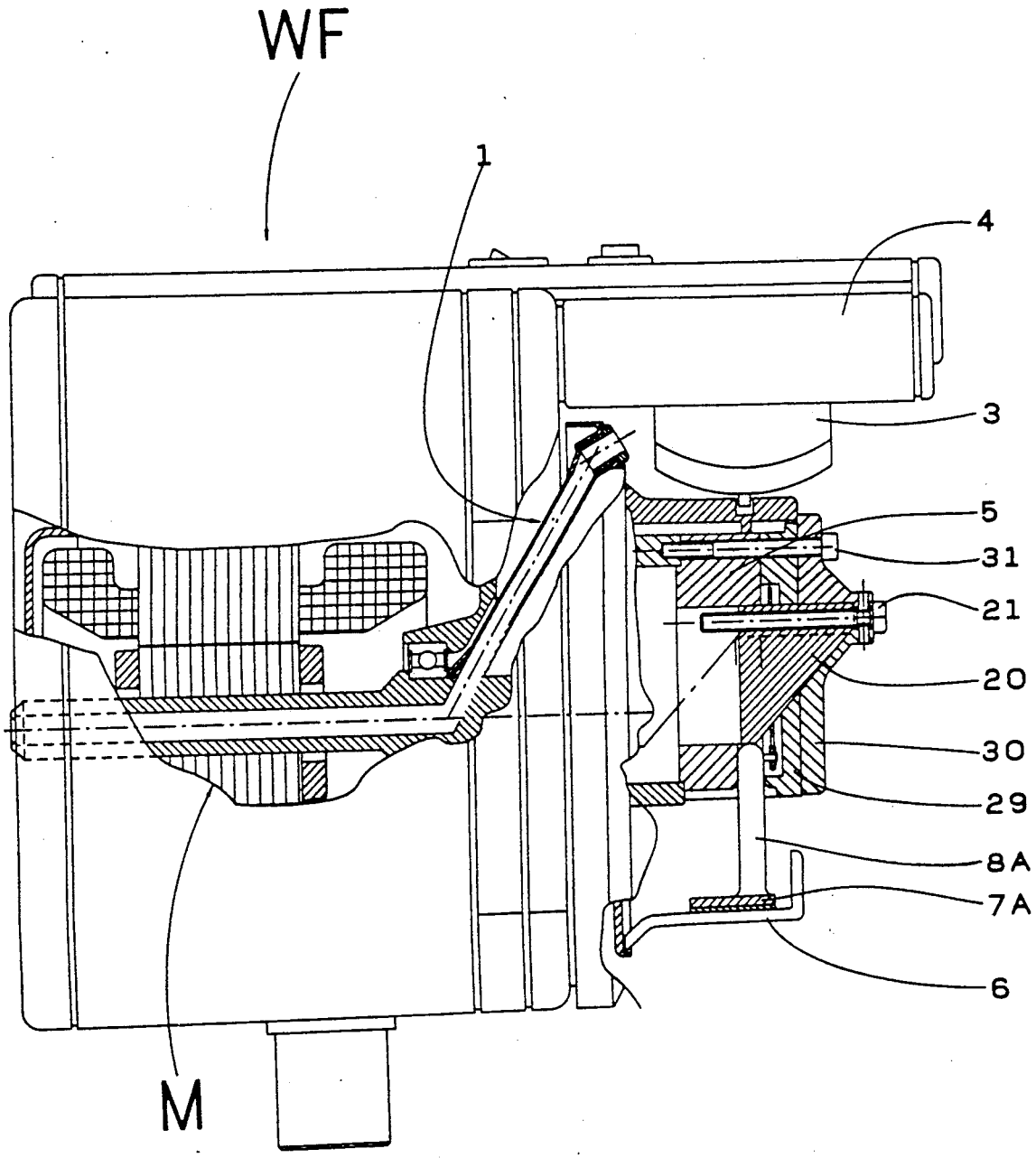
FIGS. 4, 5, 6 and FIGS. 7, 8, 9 are views corresponding to those of FIGS. 1 to 3, showing two further embodiments of the invention.
Figure 5:
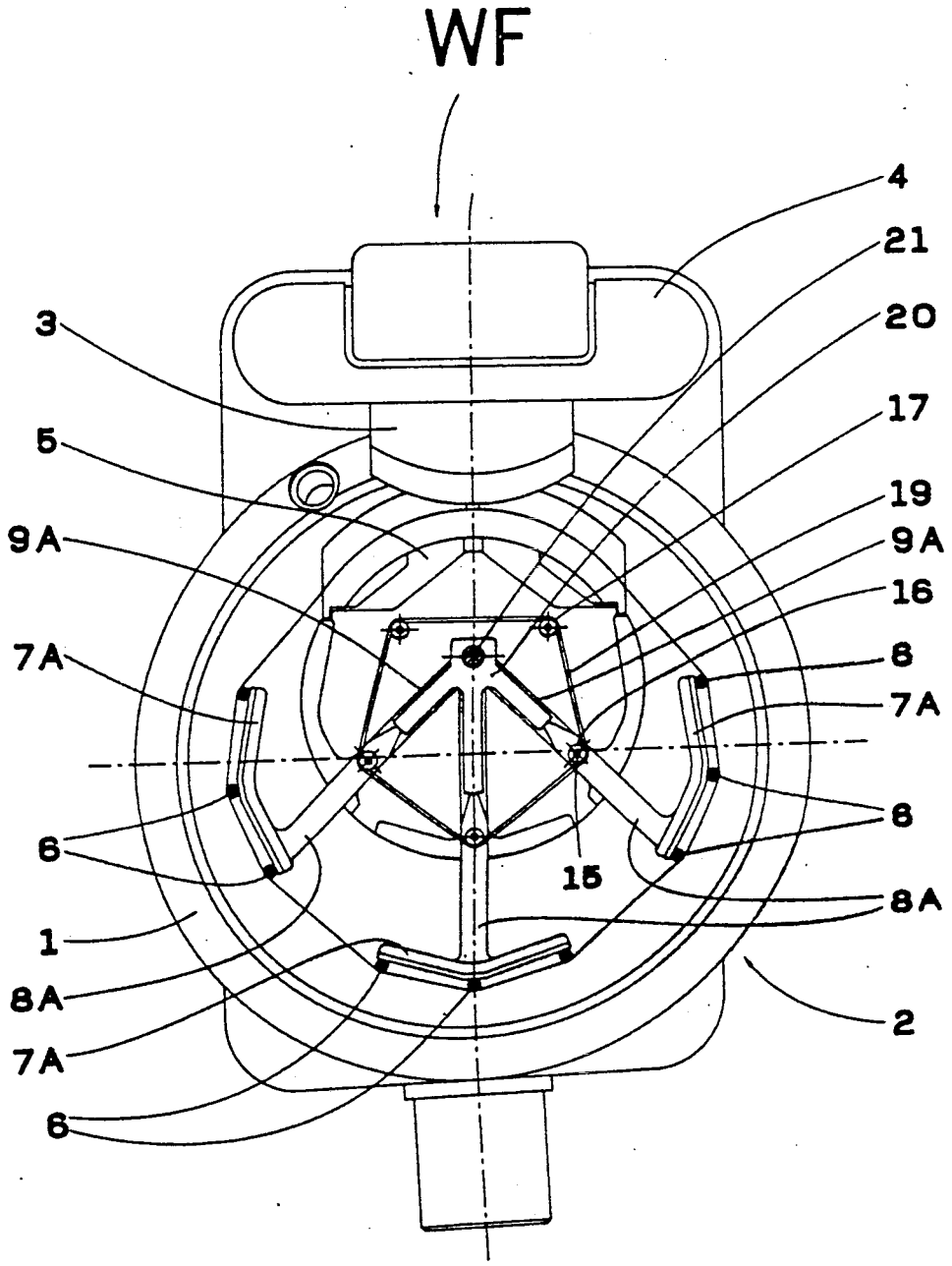
Figure 6:
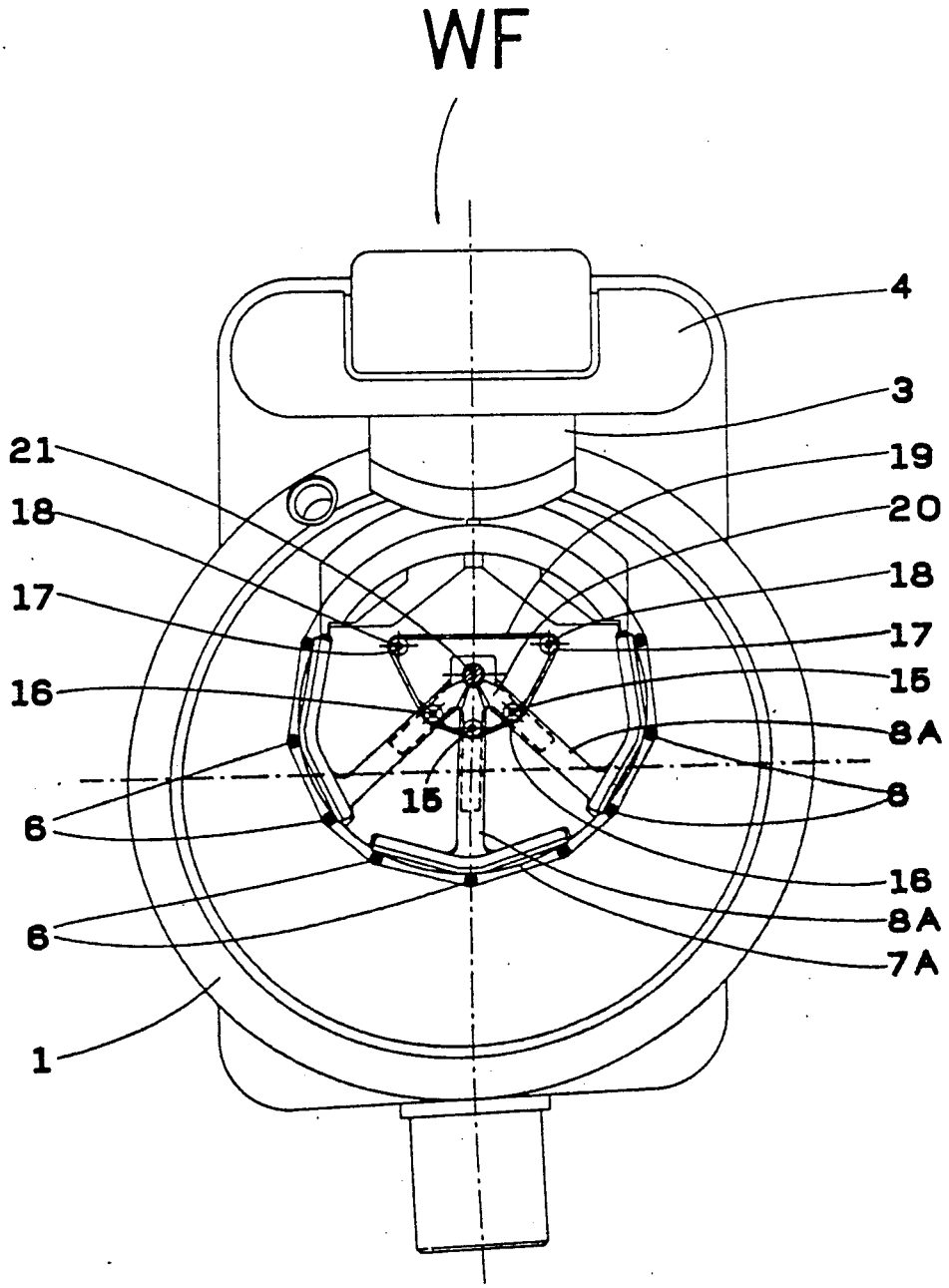

The embodiment of the invention shown in FIGS. 4, 5 and 6—also applied to the general type of measuring weft feeder being considered—still provides for three sets of three rods joined on three sectors 7A, to which there are fixed control arms 8A, slidable in prismatic guides 9A of the unit 2. The guides 9A are divergent, starting from the area of the winding unit with no rods, two of said guides forming between them an angle of about 90° and the third guide being positioned on the bisecting line of said angle. The control arms 8A each carry a pin 15 on which rotates a roller 16, while two further rollers 17 rotate on fixed pins 18 provided on the cylinder 5. A very elastic flexible belt 19 winds around the rollers 16 and 17, forming a ring and acting on said rollers with the object of urging the arms 8A to converge so that their inner ends may bear on differently inclined planes joining in a slider 20 formed as a tripod. Said tripod slider is used as a cam; it can in fact be shifted along the axis of the unit by means of a screw 21 rotatable in a flange 30.

When using this unit, one first of all releases the arms 8A by loosening one or more screws 31 (FIG. 4), which fix the flange 30 and an underlying flange 29 to the body of the cylinder 5; the appropriate position for the rods is then chosen by turning the screw 21 which shifts the slider 20, and by causing the arms 8A to slide in their guides 9A, urged by the elastic belt 19. On account of the geometry of the guides 9A, also in this case a regular and even turn length is obtained. Once the adjustment has been carried out, one simply operates the means for fixing the single arms, by acting on the screw 31, so as to lock the position of the rods 6.

Figure 7:
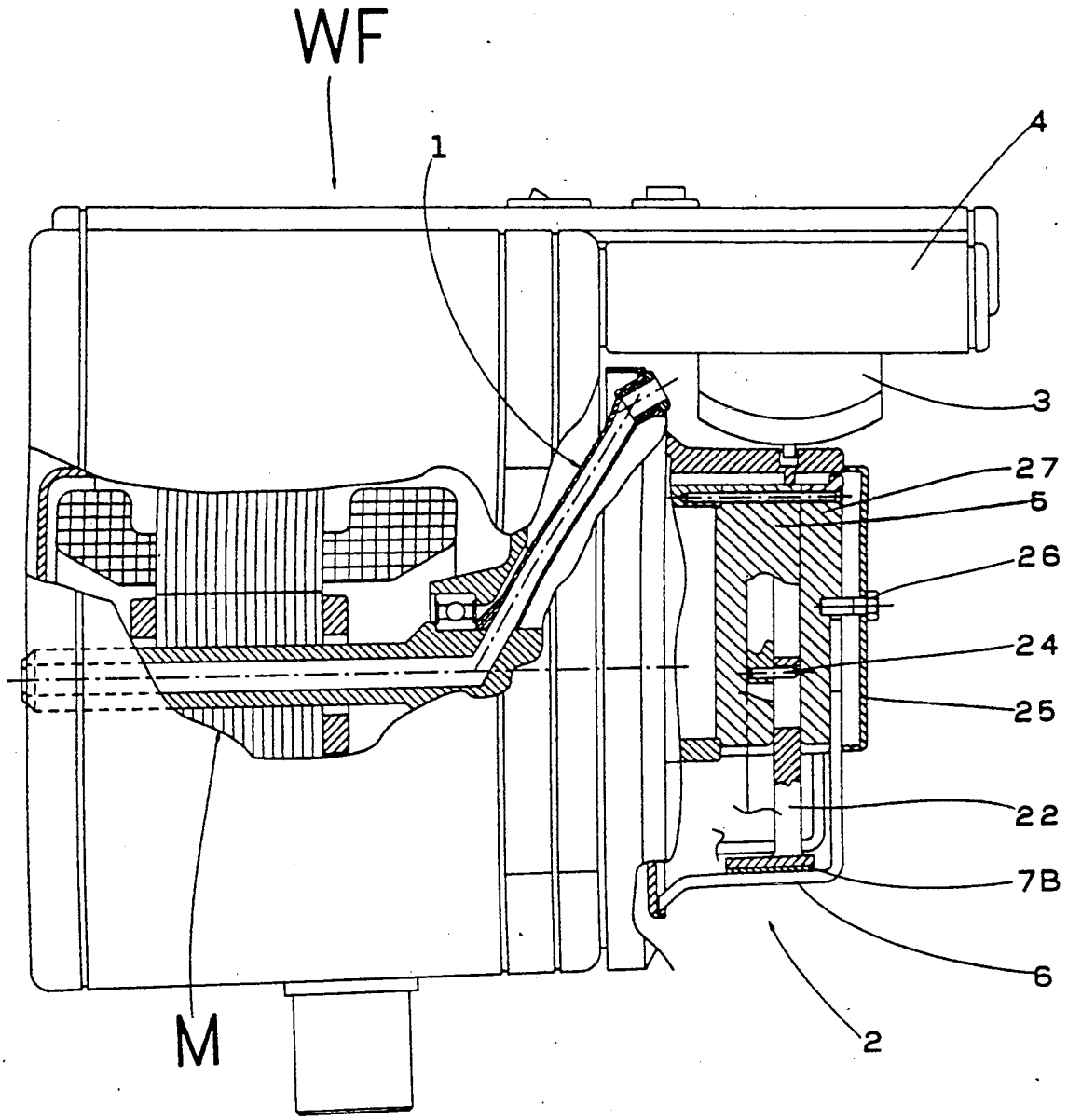
Figure 8:
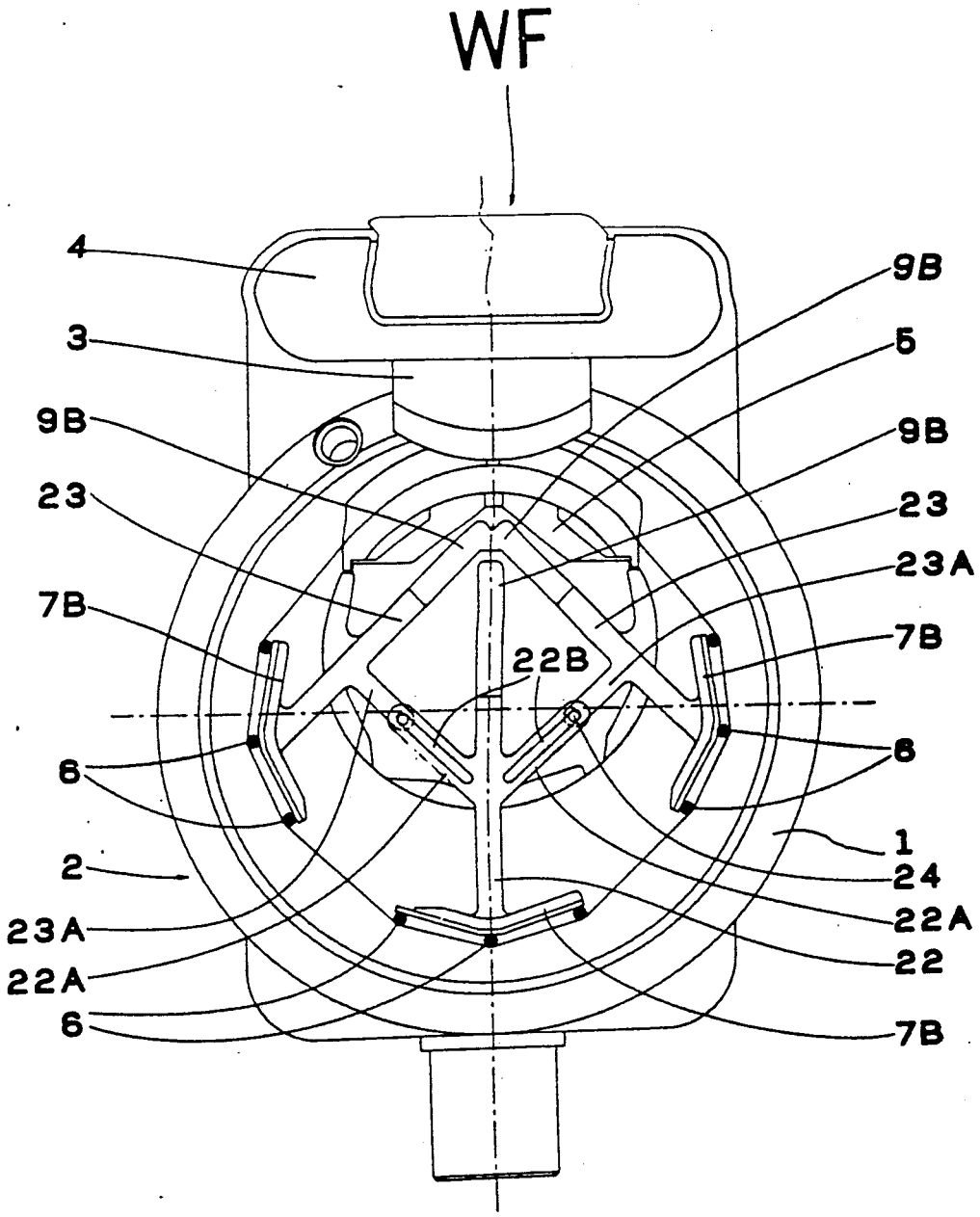
Figure 9:
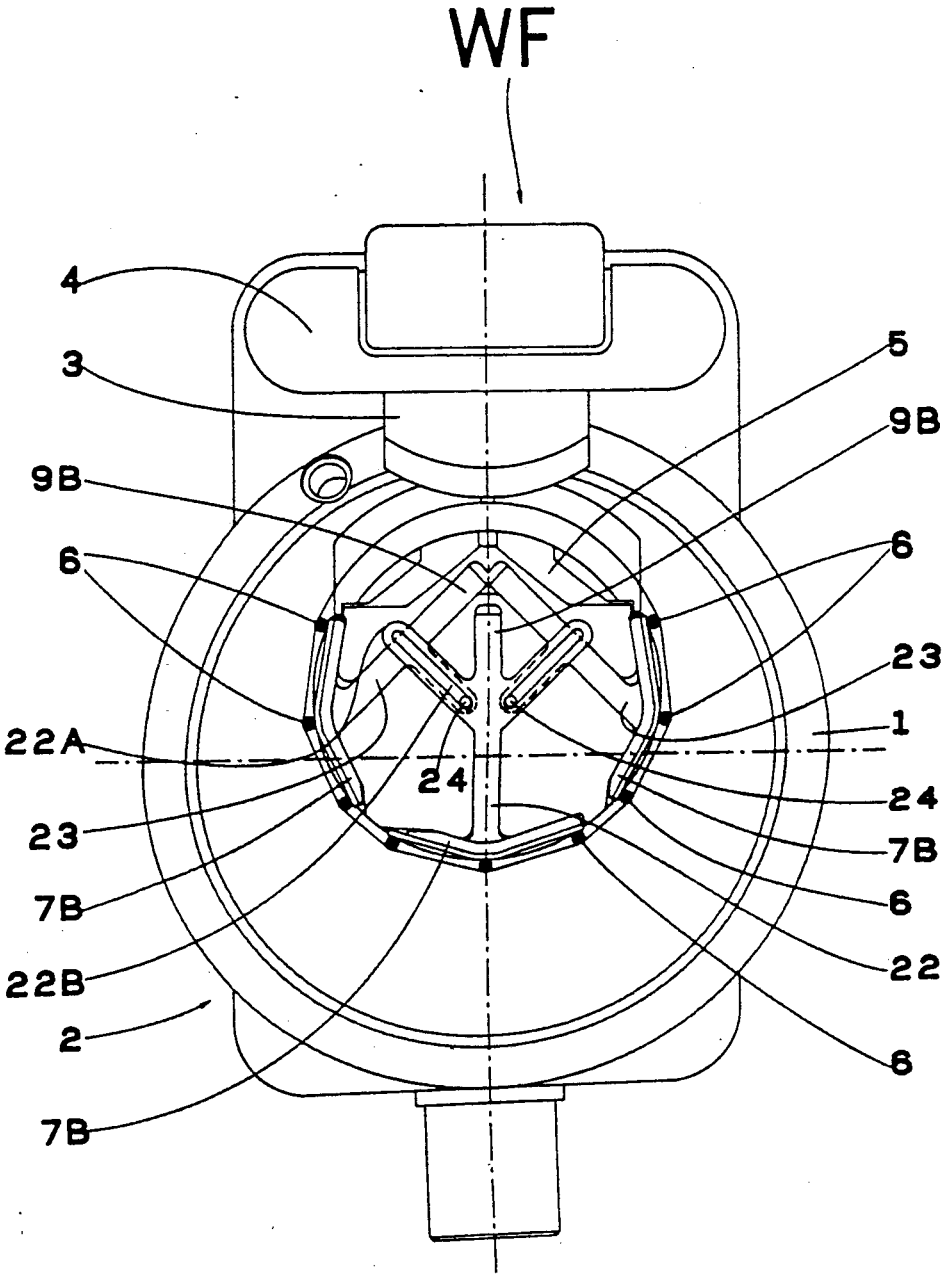

The embodiment of FIGS. 7 to 9 again provides for three sets of three rods joined on three sectors 7B, to which there are fixed control arms 22 and 23, slidable in prismatic guides 9B of the unit 2. The guides 9B are divergent, starting from the area of the winding unit with no rods, two of said guides forming between them an angle of about 90° and the third guide being positioned on the bisecting line of said angle. The arm 22 of the central sector 7B is fork-shaped, its two branches 22A having a longitudinal groove 22B, while the arms 23 of the two lateral sectors 7B have a square branch 23A on the side of the central arm. Projecting pins 24 are provided at the end of the branches 23A of the arms 23, said pins engaging in the grooves 22B of the branches 22A of the arm 22. Means are moreover provided to stop the arms 22, 23 in the selected position, consisting also in this case of an external locking member 25 (FIG. 7) fixed by one or more screws 26 to an intermediate flange 27.

When using this unit, one first of all releases said locking means and then chooses the appropriate position for the rods 6 of the central sector 7B, causing the arm 22 to slide in its guide 9B. The other two arms 23, due to the engagement of the pins 24 in the grooves 22B, follow the movements of the first arm and accordingly take up, on account of the geometry of the guides 9B, a positioning allowing obtaining also in this case the desired position of all the rods 6, with a regular and even turn length. The screws 26 of the single arms are then again tightened so as to lock the rods 6 in their position.

It is to be understood that there may be other practical embodiments of the winding unit, rightfully falling within the scope of the present invention.

I claim:

1. In a weft yarn reserve winding unit wherein the length of the turns of weft yarn thereon is variable, for use in measuring weft feeders for fluid jet looms, comprising a drum of adjustable diameter formed by a fixed eccentric cylinder and plurality of movable rods, parallel to the axis of said cylinder and surrounding a wide portion of the periphery of the cylinder, the distance of said rods from said cylinder being variable and adjustable for each rod or for groups of rods; the improvement comprising, for each rod or group of rods, a control arm slidable in a guide of the winding unit positioned perpendicularly to the axis of said unit, said arms being movable simultaneously in the respective guides under the control of a single operating member that moves the rods simultaneously toward or away from the periphery of the cylinder, and means releasably to lock said arms in said guides in any of a plurality of positions of adjustment.

2. Winding unit as in claim 1, comprising three groups of at least three rods joined in sectors, a control arm for each sector and a prismatic guide for each arm, two of said guides forming between them a wide angle, preferably of about 90°, and the third guide being positioned equiangularly between said two guides.

3. Winding unit as in claim 2, wherein the arms of said sectors each carry a rack with which engage gears controlling the movements of the arms in said guides, a first stepped gear—forming said single operating member—controlling directly the arm of the sector of the third guide and, simultaneously, through two further gears, the arms of the other two sectors, with gear ratios adapted to cause the rods simultaneously to converge or diverge.

4. Winding unit as in claim 2, wherein the arm of the sector of the third guide is fork-shaped, having two branches having a longitudinal groove to house end pins of branches of the arms of the other two sectors, so that the movement of the fork-shaped arm in its guide causes the other arms to move in their respective guides.

5. Winding unit as in claim 1, wherein the shifting of the arms in the respective guides is obtained by an axial movement of differently inclined surfaces, joining in a slider formed as a tripod which can be shifted, as a cam, by means of a screw forming said single operating member, the single arms being elastically urged to converge and being thus kept in contact with the respective inclined surface. and being thus kept in contact with the respective inclined surface.

6. Winding unit as in claim 5, wherein said arms are elastically urged to converge by means of a flexible belt, winding around rollers to form a ring and acting on said rollers which rotate on pins projecting from said arms and on at least one fixed pin projecting from the eccentric cylinder.

7. Winding unit as in claim 1, wherein said locking means consist of a locking member to be fixed by screws.

* * * * *